US006041517A

United States Patent [19]

Wang

[11] Patent Number: 6,041,517

[45] Date of Patent: Mar. 28, 2000

[54] METHOD AND RELATED BLOWING MODEL FOR DRYING AND SYNCHRONOUSLY IRONING OUT CLOTHING BY USING A BLOWING MODEL

[76] Inventor: Jyh-Sheng Wang, No. 22, Lane 96, Chiao-Hsin Rd., Hsin-Tien City, Taipei Shien, Taiwan

[21] Appl. No.: 09/178,729

[22] Filed: Oct. 26, 1998

[51] Int. Cl.[7] ..... F26B 7/00

[52] U.S. Cl. ..... 34/439; 34/440; 34/442

[58] Field of Search ..... 34/306, 362, 363, 34/382, 385, 419, 439, 440, 442, 104, 106, 621, 622; 223/67, 72, 73, 74

[56] References Cited

U.S. PATENT DOCUMENTS

| | | | |
|---|---|---|---|
| 1,570,508 | 1/1926 | Lungstras | 223/67 |
| 2,338,776 | 1/1944 | Miller | 223/70 |
| 3,429,489 | 2/1969 | Blevens | 223/67 |
| 5,361,516 | 11/1994 | Dahman | 34/440 |
| 5,394,621 | 3/1995 | Levy | 34/440 |
| 5,555,648 | 9/1996 | Griffin | 34/621 |
| 5,642,572 | 7/1997 | Manning | 34/621 |

*Primary Examiner*—Steve Gravini
*Attorney, Agent, or Firm*—Bucknam and Archer

[57] ABSTRACT

A method and related blowing model for drying and synchronously ironing out the clothing by using a blowing model, the main steps include: The porous cloth is sewn to a model of an upper half of human body. The model is comprising of an upper half portion of body, a neck portion and an upper limbs portion, and is formed in a sealed type. An air-blowing pipe is installed on the top end face of neck portion. A manifold is mounted in the neck portion and is able to be vertically stretched down to the lower end of body, and a branch manifold is mounted in the neck-manifold to surround the neck portion. The porous cloth is sewn to a model of a lower half of human body. The model comprises of a lower half portion of body and lower limbs portion, and is formed in sealed type. An air-blowing pipe is installed on the top end face of body. A manifold is mounted in the upper end of body and is able to be vertically stretched down to a crotch, and a branch manifold is mounted in the manifold to surround the abdomen of body. While the above described model is under non-blowing status, and is put into the wet clothes, the manifold and branch-manifold overlay on the stack layer of a front lapel and a collar. The hot air is blown into an air-blowing pipe by using a blower. After the model is maintained at a tensile force, the hot air will escape from the small slits among fibers of the porous cloth and will simultaneously take away the water molecules among fibers of external layers of the clothes to quickly dry the clothes and keep the same flat-orderly.

6 Claims, 5 Drawing Sheets

METHOD AND RELATED BLOWING MODEL FOR DRYING AND SYNCHRONOUSLY IRONING OUT CLOTHING BY USING A BLOWING MODEL

FIELD OF THE INVENTION

The present invention is related to a method and related blowing model for drying and synchronously ironing out clothing by using a blowing model, in particular, is related to a method of for wet clothes being covered onto an outside edge human body model made of porous cloth. After a hot air is blown into the model for maintaining a pressure, the hot air will then leak out from cloth and will simultaneously take away water molecules of the clothes to quickly dry the clothes and keep the same flat-orderly. At the same time, the present invention is also involved in the related structure of an air-blowing model.

DISCLOSURE OF THE PRIOR ART

A traditional method of drying clothing is nothing but to utilize natural wind to dry the clothes, or to use the dryer to dry. The former takes a lot of time, especially, it gets worse while the weather is bad, and the clothes after drying will be filled with wrinkles. These clothes need to be ironed out before putting on. The latter is to put the wet clothes in a sealed space of the dryer, then to heat and vaporize the moisture. These clothes are continuously stirred up during drying process. Although it may save the time by using this method, however the clothes after being dried are also filled with wrinkles. These clothes need to be ironed out before putting on, for example, it takes about 40 minutes to dry ordinary street clothes and trousers; and it takes about 6 to 10 minutes for a skilled housewife to dry every clothing and pants, not only wastes the time, but also squanders away the energy.

However, nowadays, while the industry and business activities have been progressing promptly, and the pace of life becomes faster and faster, the daily troublesome works such as washing, drying and ironing out clothes, etc. will become a heavy burden to the housewives in terms of spirit and labor, especially to those working women. Further, the above described method of drying clothes is not suitable to those who do not live in a fixed place, e.g. often to make business trips, travels and overseas tours. Up to the present, there has been no any method of practical solution to be adopted.

SUMMARY OF THE INVENTION

In view of the troublesome works to be done against the traditional clothes washing, drying and ironing out, the inventor of this application has hereby spent a great deal of time to think about its structure and continuously make improvements till reaching a satisfactory experimental result. Thus, a self-service method and related blowing model for drying and synchronously ironing out clothing by using a blowing model is provided herewith.

According to the present invention, at first, the porous cloths are sewed to make a sealed model of an upper half and lower half of human body. The model has an air-blowing pipe and is mounted with a manifold and a branch-manifold. While the model is under non-blowing status, a model of the upper half of human body is put into the wet clothes, or a model of the lower half of human body is put into the wet trousers. The manifold or branch manifold of this model can overlay on the stack layer of a front lapel or a collar or a crotch of trousers. The hot air is blown into an air-blowing pipe of the model by using a blower. After the sealed model is maintained at a tensile force, the hot air will escape from the small slits among fibers of the porous cloth and will take away the water molecules among fibers of the external layers of the clothes to quickly dry the clothes. For example, it takes about 10 to 15 minutes to dry the ordinary street clothes and trousers. Comparing with the traditional drying method to heat in the sealed space of the dryer to evaporate the moisture, it can save more than one half of the time and it can also save the time of ironing out process. The clothes and trousers after drying can keep the same flat-orderly without going through the ironing out process. And this is the main object of the present invention.

According to the present invention, while the air-blowing model is under a non-blowing status, it can be overlapped and stored like the ordinary clothes. It can also be hand-carried without taking space with very high mobility, thus, the persons who always make business trips, travels, or overseas tours and live in various places can do self-service for clothes drying and ironing out. This is another object of the present invention, According to the present invention, the air-blowing model is capable of doing self-service for clothes drying and ironing out through an ordinary blower. The power consumption is much lower than the traditional dryer has, and it is able to save the power consumption during the ironing out process. In addition, the blower can also use a connector to collect the air-blowing pipes of several models and supply the hot air simultaneously to achieve the object of saving energy. This is yet another object of the present invention.

BRIEF DESCRIPTION OF THE DRAWINGS

In order to substantially understand the above objects, features and effects of the present invention, the following detailed description wherein reference is made to the accompanying drawings, in which.

DETAILED DESCRIPTION OF THE PREFERRED EMBODIMENT

Figure 1:
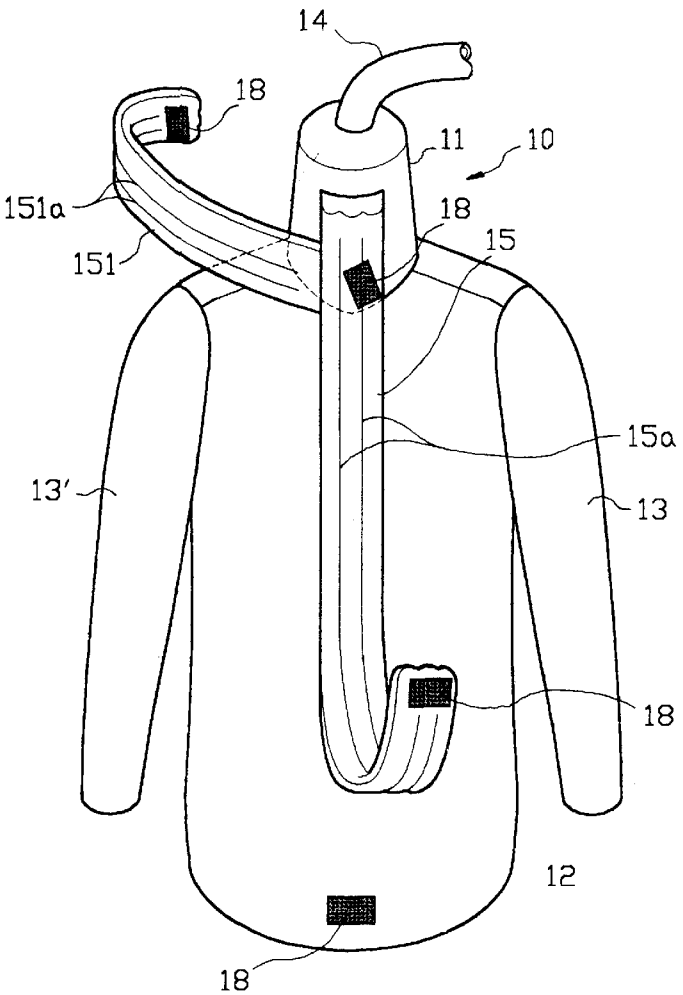
FIG. 1 is a perspective view of an air-blowing model of the upper half of human body model under air blowing status according to the present invention.

At first, illustrates a method for drying and synchronously ironing out the clothing by using a blowing model. As shown in FIG. 1, it is to sew an upper half of human body model 10 with the porous cloth. The model 10 comprises of an upper half portion 12 of body, neck portion 11 and upper limbs portion 13, 13', and formed in a sealed type. An air-blowing pipe 14 is installed on the top end face of neck portion 11, and a manifold 15 is mounted in the neck portion 11, and vertically stretches down to the lower end of body 12. And adhesive clip bands 18 are respectively mounted in the end of manifold 15 and an interface of lower end of body 12, so as to fasten the end of manifold 15. A branch manifold 151 is mounted in a basic end of the manifold 15, which can surround the neck portion 11, and the end of branch manifold 151 is fastened to the outer end of manifold 15 through an adhesive clip band 18. In order to prevent the arc degree from being top large due to expansion of air-blowing, the above mentioned manifold 15 and branch manifold 151 can sew a plurality of parting lines 15*a*, 151*a* intercommunicating in both ends on its side faces to keep the clothes flat-orderly during expanding.

Figure 2:
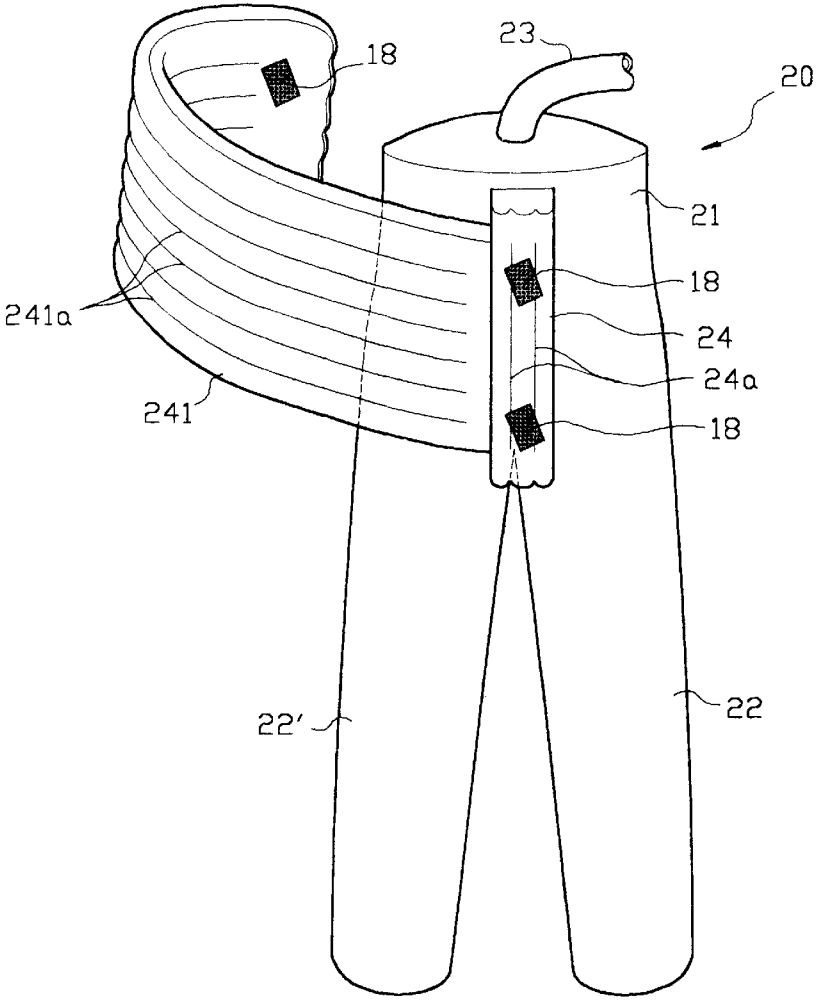
FIG. 2 is a perspective view of an air-blowing model of the lower half of human body model under air blowing status according to the present invention.

Also as shown in FIG. 2, simultaneously to sew a lower half of human body model 20 with the porous cloth. The model 20 comprises of a lower half portion 21 of body and lower limbs portion 22, 22', and is formed in a sealed type. An air-blowing pipe 23 is installed on the top face of body 21 and a manifold 24 is mounted on the upper end of body 21, and vertically stretches down to the crotch. And a branch manifold 241 is mounted in the manifold 24, which can surround the abdomen of body 21, then the adhesive clip bands 18 are respectively mounted in the inner edge of the end of the branch manifold 241 and outer end of manifold 24 so as to fasten the end of the branch manifold 241. In order to prevent the arc degree from being too large due to expansion of air-blowing, the above mentioned manifold 24 and branch manifold 241 can sew a plurality of parting lines 24*a*, 241*a* intercommunicating in both ends on its side faces to keep the clothes flat-orderly during expanding.

Figure 3:
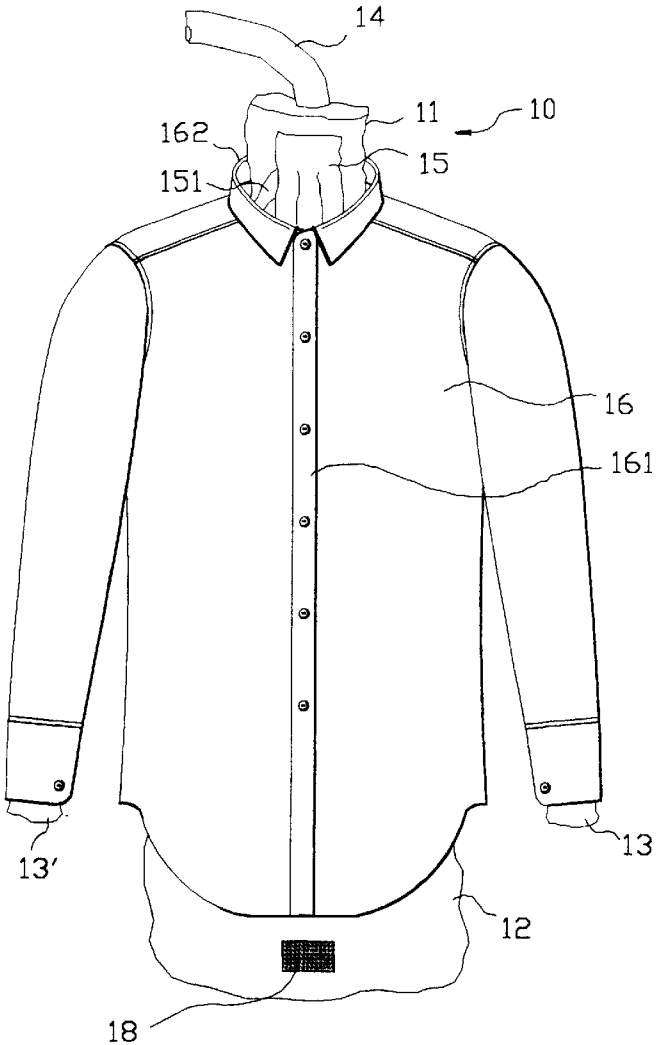
FIG. 3 is a schematic view of FIG. 1, the model is put into the wet clothes while under non-blowing status.
Figure 6:
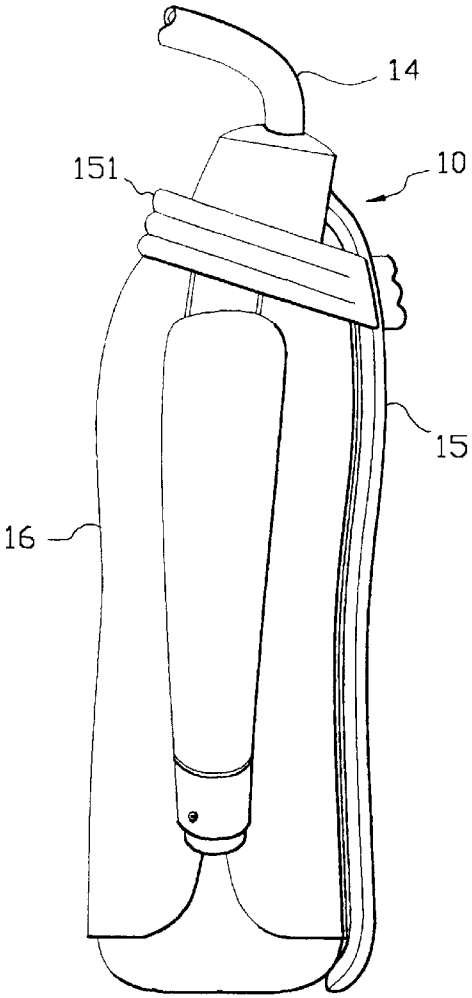
FIG. 6 is a side view of FIG. 5.
Figure 5:
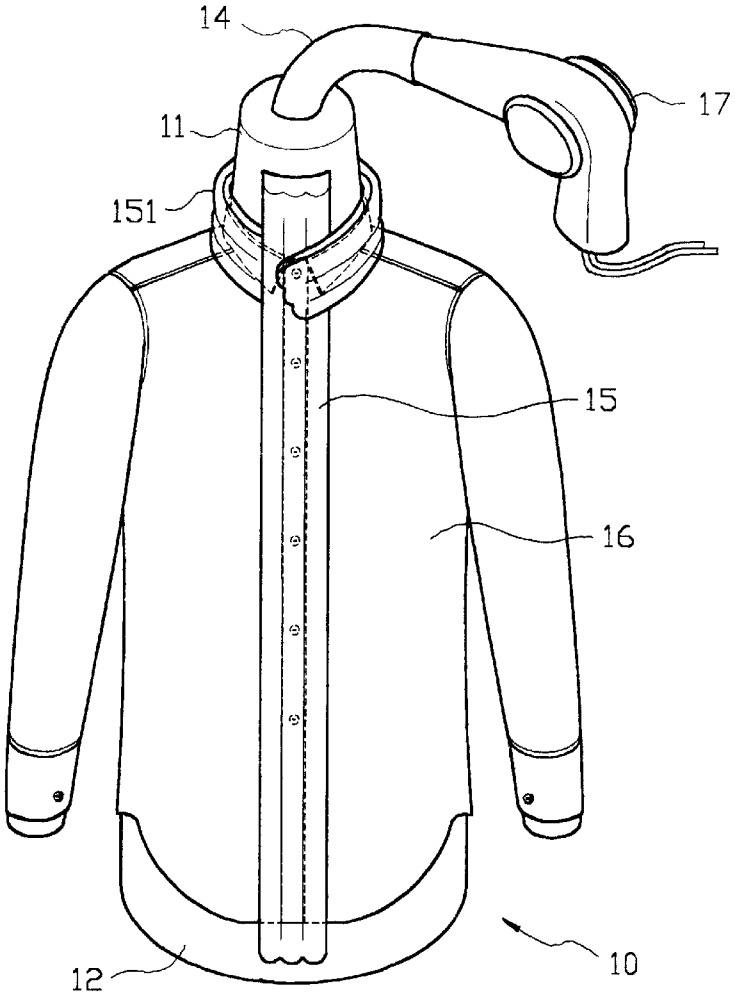
FIG. 5 is a perspective view of an usage status of FIG. 3, wherein shows the manifold overlays on the stack layer of a front lapel, and the branch manifold surrounding the neck portion overlays the stack layer of a collar.

Referring to FIG. 3, FIG. 5 and comparing with FIG. 6, takes the street coat 16 for example, while the model of upper half body 10 is under non-blowing status and is put into the wet clothes 16, the upper limbs 13, 13' are also put into two sleeves separately, and the manifold 15 on neck portion will overlay on the stack layer along the front lapel of the street coat 16. The end is fastened to the lower end of body 12 by an adhesive clip band 18, and the branch manifold 151 which surrounds the neck portion 11 will overlay on the stack layer of clothes. After preparation is ready, the hot air is blown into an air-blowing pipe 14 with a blower 17, and then the model 10 will gradually expand to support the clothes 16 till maintain a fixed tensile force. The hot air will escape from the slits among fibers of the porous cloth and take away the water molecules among fibers of external layer of the clothes. Due to the stack layer portion of the clothes 16, e.g. the front lapel 161 and the collar 162 are the stack layers with multiple layers, and are overlayed by manifold 15 and branch manifold 151 separately, the hot air will escape from the model 10 toward outside and simultaneously from the manifold 15 and branch manifold toward the stack layer, such that the clothes can be dried quickly. And it is under slight tensile force status during the drying process, therefore it is possible to keep the clothes flat-orderly after drying without the ironing out process.

Figure 4:
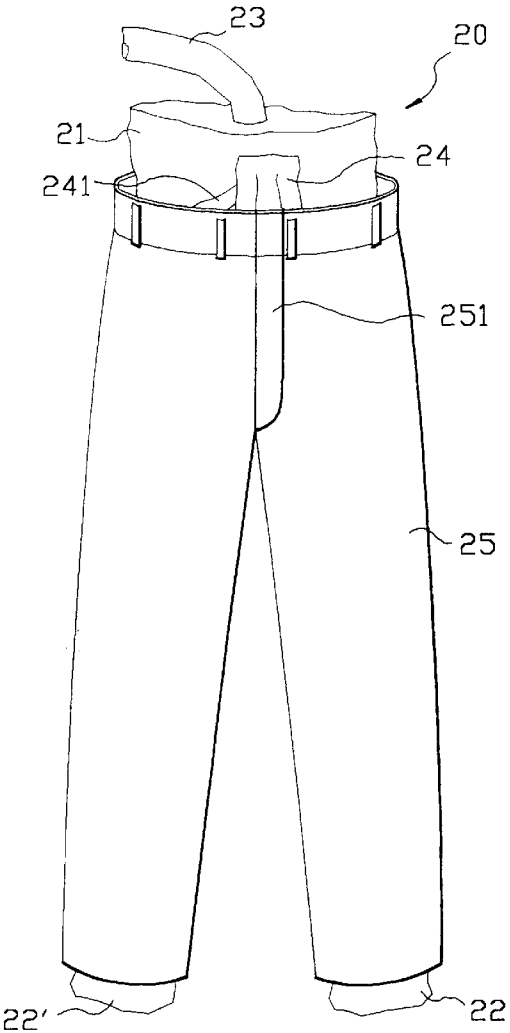
FIG. 4 is a schematic view of FIG. 2, the model is put into the wet trousers while under non-blowing status.
Figure 8:
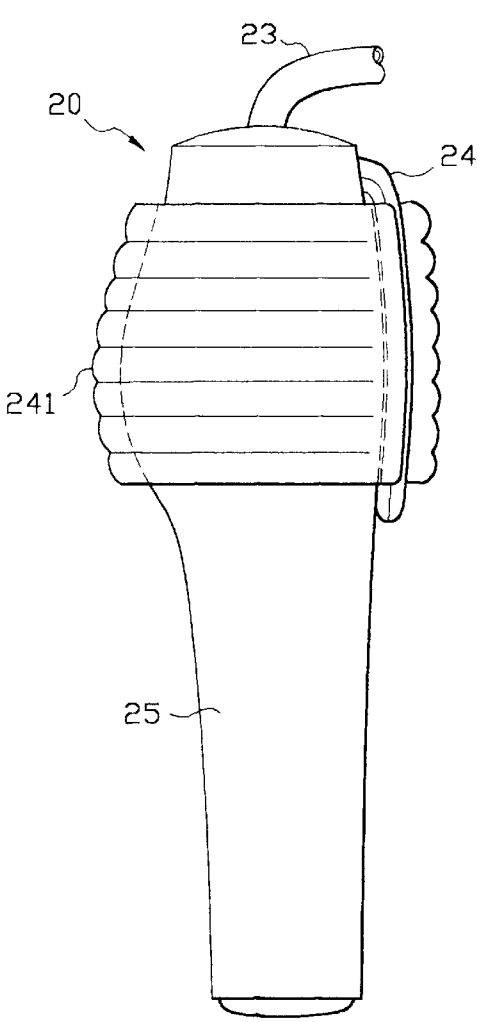
FIG. 8 is a side view of FIG. 7.
Figure 7:
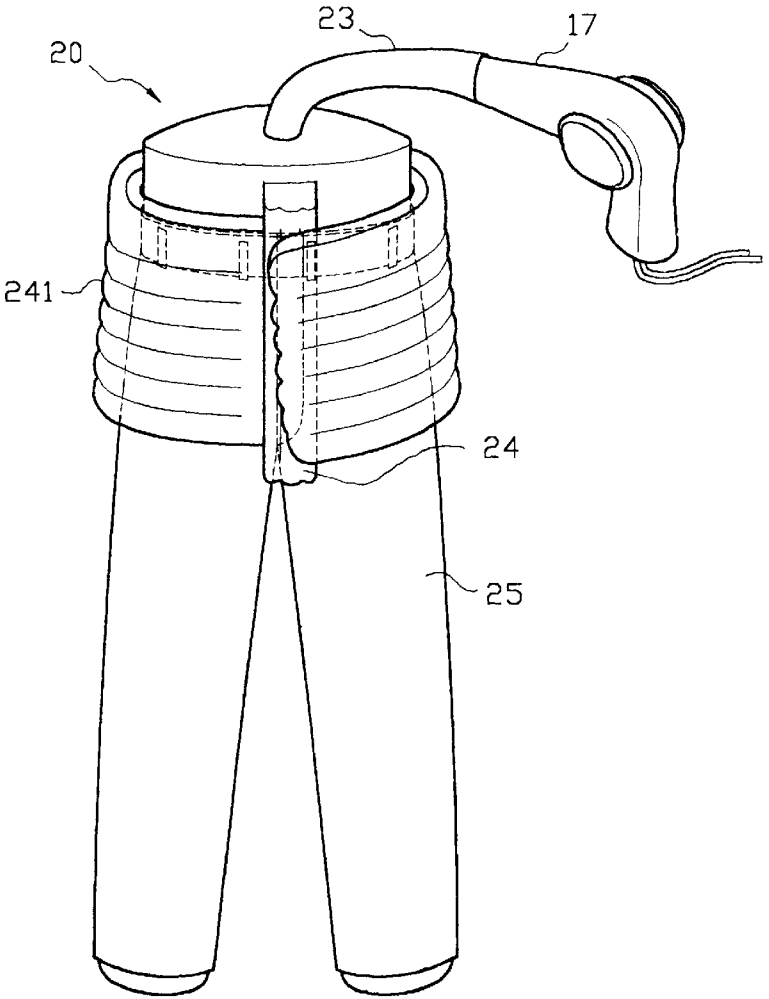
FIG. 7 is a perspective view of a usage status of FIG. 4, wherein shows the manifold overlays on the stack layer of a crotch of trousers, and the branch manifold surrounds the lower abdomen of body.

Referring to FIG. 4, FIG. 7 and comparing with FIG. 8, further to take the street trousers 25 for example, through the same steps, while the mold of lower half body 20 is under non-blowing status and is put into the wet trouser 25, the lower limbs 22, 22' are also put into a pair of underpants, separately, and the manifold 24 will overlay on the stack layer along the crotch of trousers portion 251. The end is clip-fastened to the outer end of manifold 24 by an adhesive clip band 18, and the branch manifold 241 which surrounds the abdomen and the buttocks will overlay on the stack layer portion with liners. After preparation is ready, the hot air is again blown into an air-blowing pipe 23 through a blower 17, and the model 20 will gradually expand to support the trousers 25 till maintain a fixed tensile force. The hot air will escape from the slits among fibers of the porous cloth and take away the water molecules among fibers of the external layer of trousers. Due to the stack layer portion of the trousers 25, e.g. the crotch of trousers portion 251 and the abdomen and buttocks portions are the stack layers with multiple layers of pockets and liners, and are overlaid by manifold 24 and branch manifold 241 separately, the hot air will escape from the model 20 toward outside and simultaneously from the manifold 24 and branch manifold 241 toward the stack layers, such that the trousers can be dried quickly. And it is under slight tensile force status during the drying process, therefore it is possible to keep the trousers flat-orderly after drying without the ironing out process.

Figure 9:
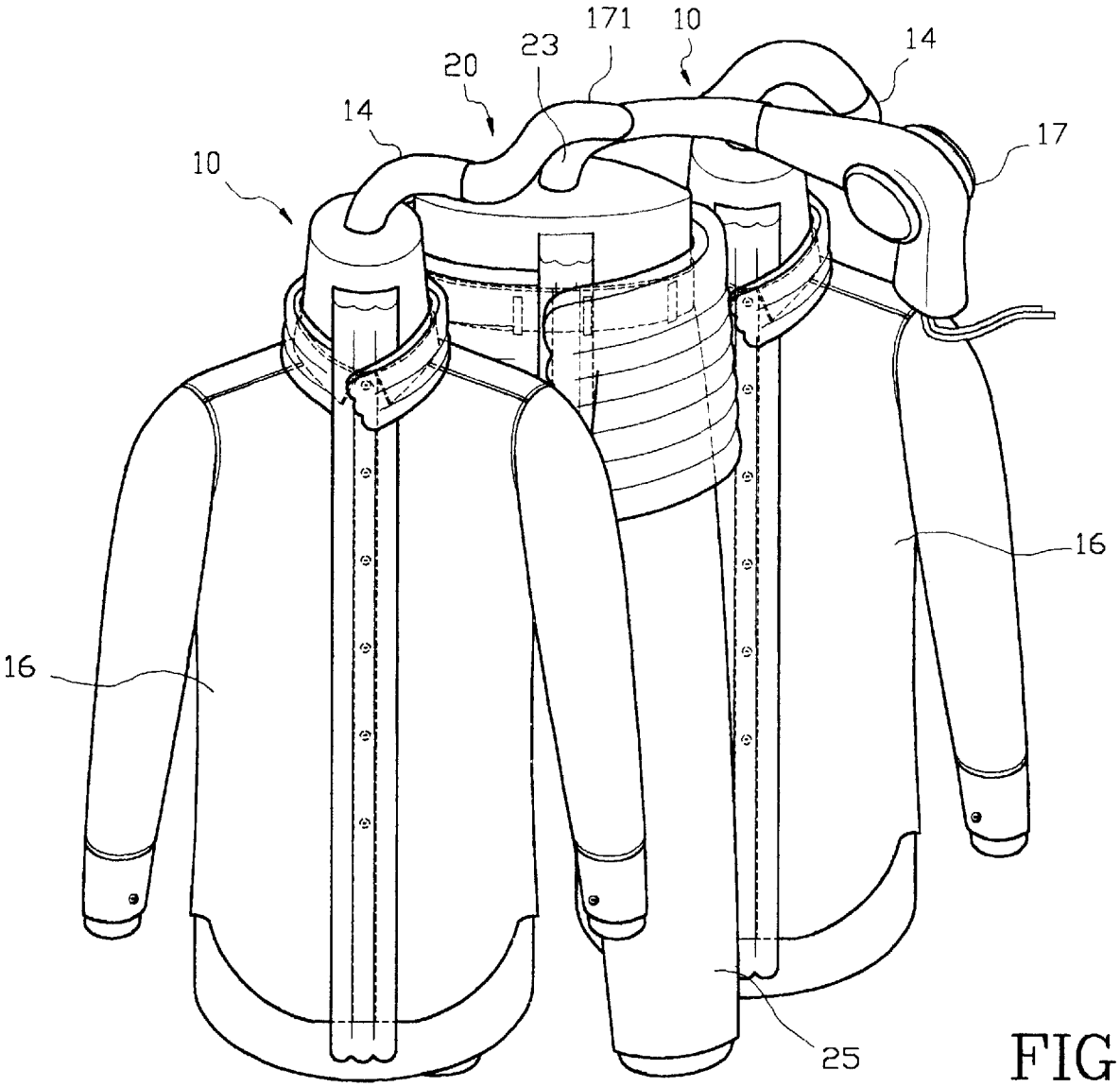
FIG. 9 is a schematic view of the blower for collecting several blowing pipes of the blowing models by a connector, simultaneously providing with hot air.

According to the present invention, the external layers of manifolds 15, 24 and branch manifolds 151, 241 of the aforesaid models 10, 20 can also be sewn with a non-porous material to drive the hot air inside the manifolds 15, 24 and branch manifolds 151, 241 strongly into the inner edge layers for permeation. It may save a portion of energy. Further, as shown in FIG. 9, the blower 17 can also use a connector 171 to collect air-blowing pipes of several models and supply the hot air simultaneously to achieve the object of saving energy.

To sum up all the foregoing, it can be portable with high mobility by using the present invention, it is able to dry the clothes without ironing out process as well as to save the energy. Thus, it is really an invention with novelty and having practical values. The foregoing descriptions are only preferred embodiments of the present invention, and are not limited to the working range of the present invention; namely they do not depart from the equal alternations and modifications made by the claims of the present invention, and such alternations and modifications should still belong to the covering category of this invention.

What is claimed is:

1. A method and related blowing model for drying and synchronously ironing out clothing by using a blowing model, the main steps of which comprise:

the porous cloth is sewn to a model of an upper half of human body, the model contains an upper half portion of body, a neck portion and an upper limbs portion, and is formed a sealed type; an air-blowing pipe is installed on the top end face of neck portion, a manifold is mounted in the neck portion, and a branch manifold is mounted in the manifold;

the porous cloth is sewn to a model of a lower half of human body, the model contains of a lower half portion of body and lower limbs portion, and is formed in a sealed type; an air-blowing pipe is installed on the top end face of body; a manifold is mounted in the upper end of body, and a branch manifold is mounted in the manifold;

while the above described model is under non-blowing status, and is put into wet clothes and trousers respectively, then overlay the manifold and branch-manifold on the stack layer portion, the hot air is blown into an air-blowing pipe by using a blower; after the model is maintained at a tensile force, the hot air will escape from the small slits among fibers of the porous cloth and will simultaneously take away the water molecules fibers of external layers of the clothes to quickly dry the clothes and keep the same flat-orderly.

2. A method and related blowing model for drying and synchronously ironing out clothing by using a blowing model according to claim 1, wherein the manifold in the neck portion of the upper half body model being vertically stretched down to the lower end of body can overlay on the stack layers of a front lapel portion of clothes, and its end is fastened to the lower end of body by an adhesive clip band; a branch manifold surrounding the neck portion of body can overlay on the stack layers of a collar, and its end is fastened to the outer end of manifold by an adhesive clip band.

3. A method and related blowing model for drying and synchronously ironing out clothing by using a blowing model according to claim 1, wherein the upper end manifold of the lower half body model being vertically stretched down to a crotch can overlay on the stack layers of a crotch of trousers portion; a branch manifold surrounding the abdomen of body can overlay on the stack layers with liners; and its end is fastened to the outer end of manifold by an adhesive clip band.

4. A method and related blowing model for drying and synchronously ironing out clothing by using a blowing model according to claim 2, wherein the external layers of the manifold and branch manifold are sewn by non-porous materials.

5. A method and related blowing model for drying and synchronously ironing out clothing by using a blowing model according to claim 2, wherein a plurality of parting lines intercommunicating in both ends are sewn on end faces of the manifold and the branch manifold.

6. A method and related blowing model for drying and synchronously ironing out clothing by using a blowing model according to claim 1, wherein the blower can collect the air-blowing pipes of several air-blowing models through a connector and simultaneously supply hot air.

* * * * *